United States Patent [19]

Lin

[11] Patent Number: 4,942,685

[45] Date of Patent: Jul. 24, 1990

[54] LIGHT ILLUMINATED PHOTO FRAME

[75] Inventor: Ling-Yung Lin, Taipei, Taiwan

[73] Assignee: New Fei Lien Ent. Co., Ltd., Taipei, Taiwan

[21] Appl. No.: 409,305

[22] Filed: Sep. 19, 1989

[51] Int. Cl.[5] ..... G09F 13/00; A47G 1/00

[52] U.S. Cl. ..... 40/152.2; 40/546

[58] Field of Search ..... 40/152.2, 152.1, 546, 40/547

[56] References Cited

U.S. PATENT DOCUMENTS

| | | | |
|---|---|---|---|
| 1,359,662 | 9/1920 | Blyth | 40/152.1 |
| 2,499,063 | 2/1950 | Hammer | 40/546 |
| 2,529,713 | 9/1950 | Thurston | 40/152.2 |
| 2,779,938 | 1/1957 | Pifer | 40/152.2 |
| 3,698,793 | 10/1972 | Tellerman | 40/546 |
| 3,718,032 | 5/1967 | Robinson et al. | 40/152.2 |
| 4,009,535 | 3/1977 | Stock | 40/546 |
| 4,055,014 | 10/1977 | Schmidt et al. | 40/442 |
| 4,195,431 | 4/1980 | Neufeld | 40/367 |
| 4,441,268 | 4/1984 | Scott | 40/156 |

FOREIGN PATENT DOCUMENTS

| | | | |
|---|---|---|---|
| 468319 | 2/1950 | Italy | 40/152.2 |

*Primary Examiner*—Peter R. Brown
*Assistant Examiner*—James M. Gardner
*Attorney, Agent, or Firm*—Karl W. Flocks

[57] ABSTRACT

The present disclosure is concerned with a photo frame with a hidden light illumination loop made of light transmitting material, a DC or AC-operated light source can provide necessary light delivered by the light illumination loop all around the frame and cast on the photo located within the frame. The light source is preferably made of LED bulb components. The frame includes a front cover having a central opening for the exposition of a located photograph, an intermediate light illumination loop and a supporting frame. The illumination loop is removably engaged with the supporting frame with the front cover attached to the flanges of the supporting frame and the illumination loop hidden behind the front cover without being noticed. The photo frame can be designed to have various shapes as desired.

3 Claims, 5 Drawing Sheets

LIGHT ILLUMINATED PHOTO FRAME

FIELD OF THE INVENTION

The present invention relates to a light illuminated photo frame and more particularly to a photo frame assembly having a front cover, an intermediate illumination loop and a supporting frame; the illumination loop is removably engaged with the supporting frame with the front cover attached to the flanges of the supporting frame so that the illumination loop can be hidden therebehind without being noticed. Moreover, the light source is made of LED bulb components which are actuated by batteries disposed in a battery box behind the supporting frame or by AC power source with the help of a rectifier and the light can be transmitted by the peripherally disposed illumination loop all around the photograph located in the photo frame in a splendid and fascinating manner.

Conventionally, photo frames have been designed and produced in various kinds of shape and of different materials. The variations thereof mainly focus on the artistic outlooks and the structures to hold the pictures or photos; however, no photo frames of prior art have ever been produced to provide constant illumination on the photos disposed therein by way of AC or DC operated light source in a splendid and fascinating manner, creating heart-warm feeling for people when viewed in the dark. In order to provide people with a wonderful and fascinating feeling about the pictures, of people whom one cherishes most, disposed in photo frames in the dark, the present inventor has worked out a novel photo frame which is constantly illuminated by a light source powered by AC or DC.

The primary object of the present invention is to provide a light illuminated photo frame which is equipped with a peripherally disposed illumination loop made of light transmitting materials in association with battery operated LED bulb components which provide constant illumination evenly around the picture or photograph disposed in the photo frame of the present invention.

One other object of the present invention is to provide a light illuminated photo frame which is provided with a number of light reflection pieces such as aluminum foils or mirrors around the flanged walls of the supporting frame so that light can be better focused on the photograph.

One further object of the present invention is to provide a light illuminated photo frame which is variably defined in almost any shape as desired.

One still further object of the present invention is to provide a light illuminated photo frame which is provided with a light sensitive CDS component so as to control the on/off status of the present photo frame automatically.

One still further object of the present invention is to provide a light illuminated photo frame which is equipped with an illumination loop made of a neon light tube as the size of the photo frame is relatively large.

One still further object of the present invention is to provide an illuminated photo frame which can be operated in either AC or DC.

To better illustrate the structure and operation modes and features of the present invention, a number of drawings are given in company with a detailed description of the preferred embodiment of the present invention, in which:

DETAILED DESCRIPTION OF PREFERRED EMBODIMENT

Figure 1:
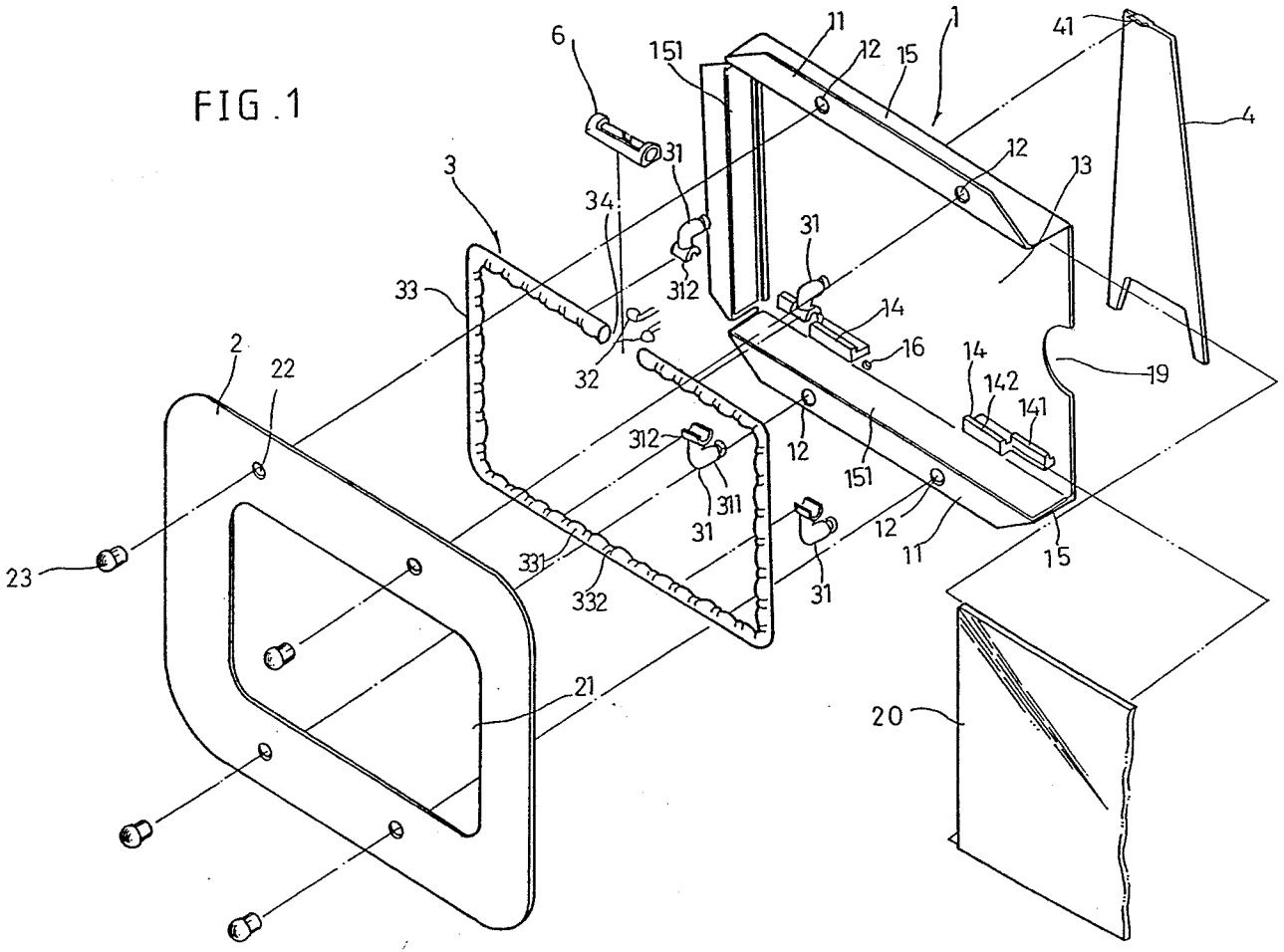
FIG. 1 is a diagram showing the exploded components of the present invention.
Figure 2:
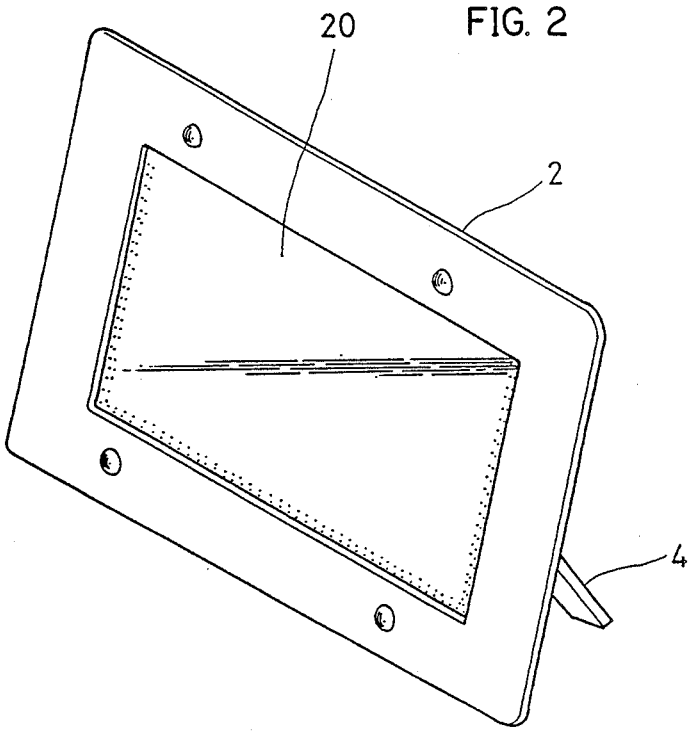
FIG. 2 is a diagram showing the erected light illuminated photo frame of the present invention.

Referring to FIG. 1, the present light illuminated photo frame comprises a front cover 2, an intermediate illumination loop 3 made of light transmitting materials, and a supporting frame 1 wherein the front cover 2 is removably attached to the flanges of the supporting frame 1 with the illumination loop 3 disposed therebetween without being noticed. A central opening 21 is defined on the front cover 2 with a pair of holes 22 disposed on each of the symmetric edges thereof in alignment with a pair of holes 12 on the side flanges of the supporting frame thereby the front cover can be removably secured to the supporting frame by screws 23 which are adapted to extend through holes 22 and holes 12; or by glue with the illumination loop located therebetween unnoticed.

The supporting frame is provided with 3 flanges along 3 edges thereof, each consisting of a vertical wall 15 and an outward extended horizontal fold 11. On each horizontal fold 11 there are disposed one or two holes 12, permitting the front cover 2 made of various materials to be attached to the supporting frame either by screws or glue, depending on the material of the front cover 2.

To support the illumination loop 3 in place, the support frame 1 is provided with a number of supporting elements 31 disposed symmetrically on each side of the front face thereof; each supporting element is comprised of a leg portion 311 and an arcuate grasp portion 312 which is of such a size that the illumination loop 3 can be tightly fitted therein; and the leg portion 311 is inserted into a hole 16 on the front face.

Figure 6B:
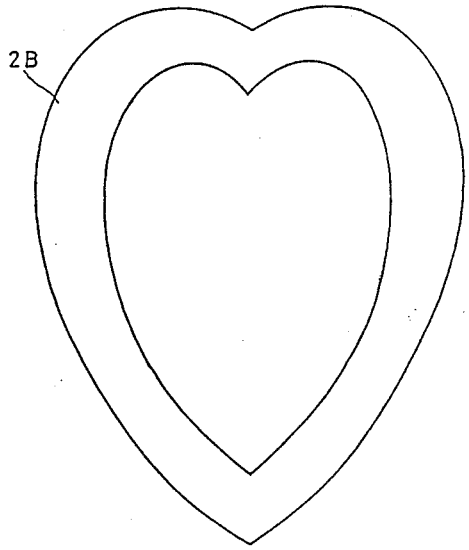
FIGS. 6A and 6B are diagrams showing variations or modifications of the shape of the photo frame of the present invention.
Figure 6A:
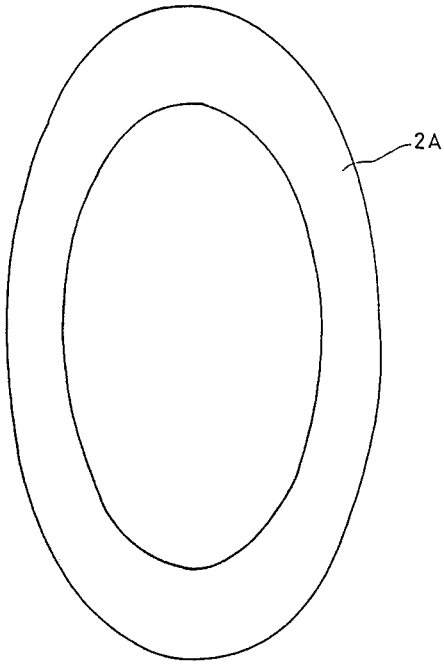

The reference numeral 2A in FIG. 6A designates a variation or another species of the frame of the present invention. The reference numeral 2B in FIG. 6B shows another variation or species of the photo frame of the present invention. The reference numeral 31 designates a supporting element which includes an arcuate grasp portion 312 adapted to be associated with the loop 3.

Figure 7:
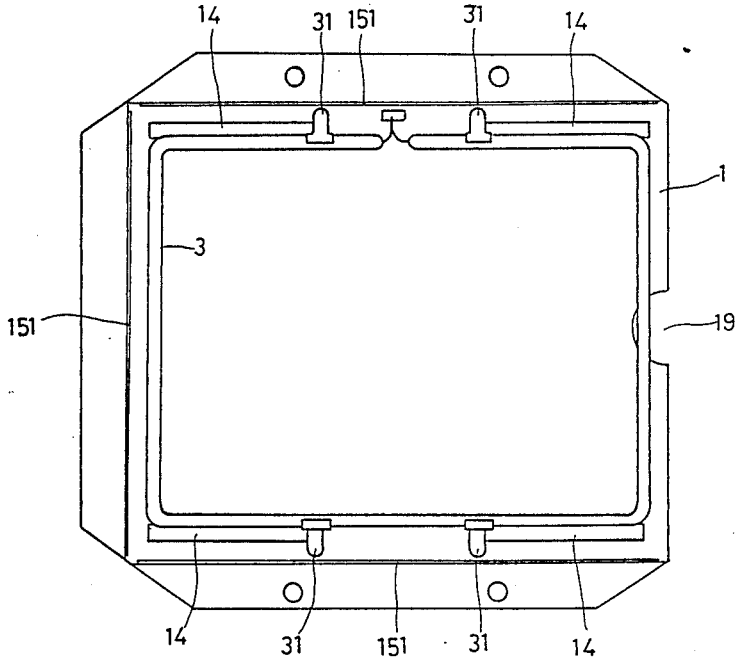
FIG. 7 is a diagram showing the use of a neon light tube as an illumination loop.

In FIG. 7 the reference numeral 19 designates a semicircular cutout or recess which provides for facility in the removal of a photo or picture from the illustrated assembly.

Figure 5B:
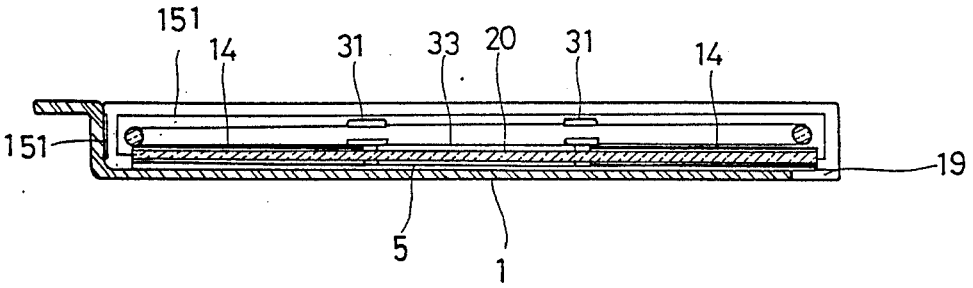
FIG. 5B is another sectional view showing the location of the light reflection piece on the vertical walls of the supporting frame.
Figure 3:
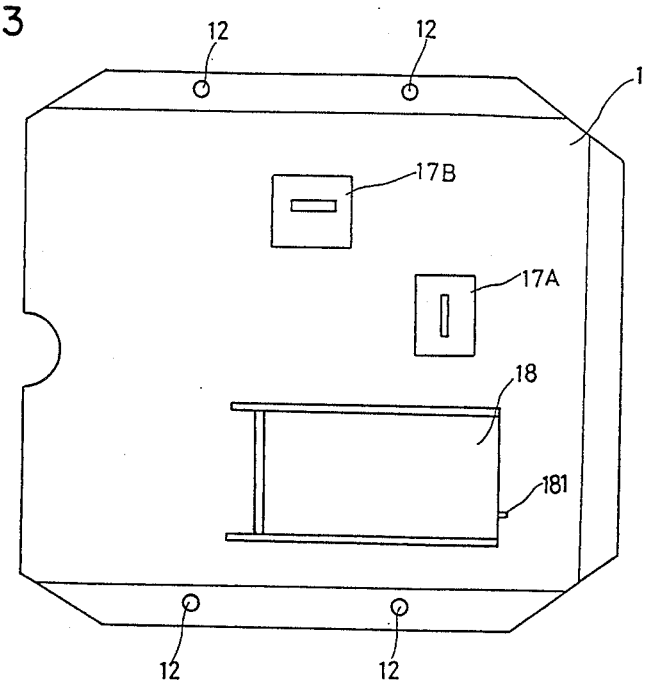
FIG. 3 is a diagram showing the rear side of the supporting frame thereof.
Figure 4:
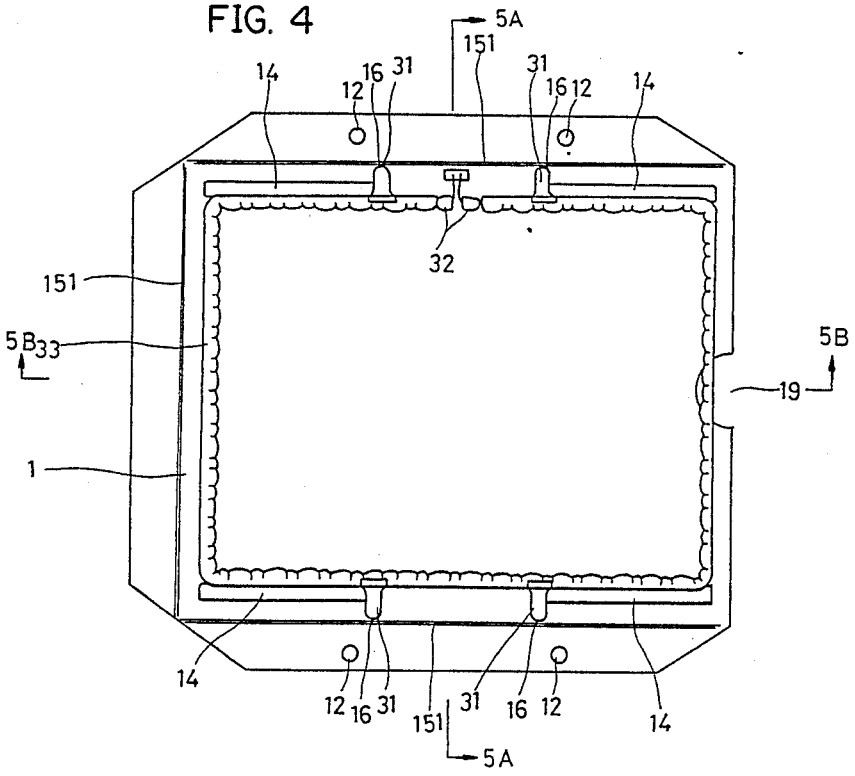
FIG. 4 is a diagram showing the illumination loop being secured to the supporting frame.
Figure 5A:
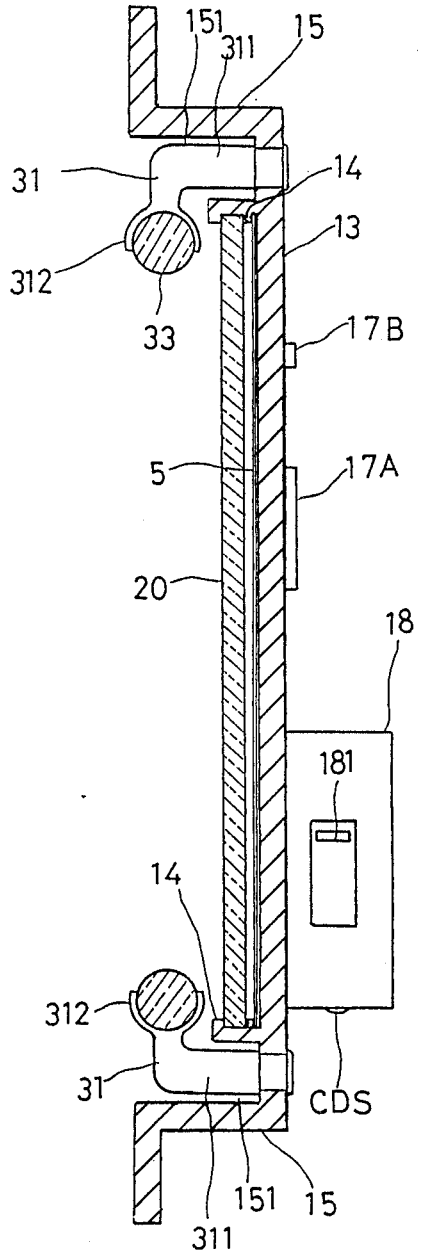
FIG. 5A is a sectional view of the assembled photo frame with a photograph and a glass secured in place.

As shown in FIG. 5A, the reference numeral 13 designates the rear wall of the supporting frame 1.

The reference numeral 33 in FIG. 1 designates one vertical leg of the rectangular loop 3.

Importantly, as shown in FIGS. 6A and 6B, the photo frame of the present invention can be designed in any kind of shape, commonly in rectangular, elliptical and heart-like form. The illumination loop 3 and the front cover 2 must be accordingly made to comply with each kind of structural figure.

The materials used to make the front cover 2 can range from plastics, acrylic resin, wood, ceramics to metal. The front cover 2 can be easily secured to the supporting frame 1 either by screws or by glue. To facilitate the glue attachment, the surfaces of the engagement of the supporting frame and the front cover 2 are finished rough.

Each illumination loop 3 has a cut 34 at the middle of at least one side thereof for the disposition of two LED bulb components 32. There are a number of colors available of the LED bulb components for people to choose according to their preference.

At the rear side of the supporting frame 1 is disposed a battery box 18 in which a couple of commonly used batteries are received for the supply of electric power. As illustrated in FIG. 5A a light control switch CDS is a component provided on the box 18 so that the LED components 32 can be controlled to switch on and off automatically by external light intensity. An adapter jack 181 is disposed on the battery box 18 for the connection of a rectifier thereto.

A couple of orthogonally disposed slots 17A, 17B are placed on the back side of the supporting frame 1 and a supporting leg 4 with the top engagement end 41 in selective registry with one of the slots enables the photo frame of the present invention to be located in either way.

As shown in FIGS. 1, 5A, 5B to better focus the light generated by the LED light bulb components 32 onto the photograph disposed in the photo frame, a number of reflection pieces 151, such as aluminum foils or mirrors, are disposed on the 3 surrounding flanged walls of the supporting frame 1. In FIG. 1, the perspective view of FIG. 1, the reflection means 151 are shown as strips on the surrounding flanged walls of the frame 1. In addition, a section of curvilinear reflection shelter 6 is disposed at the place where the LED light components are located, and a pair of supporting elements 31 are adopted to secure the LED lights in place, as shown in FIG. 1. The light reflection shelter can help effectively focus the scattered light produced by the LED bulb components 32 on the photograph disposed in the photo frame.

Referring to FIG. 1, there are 4 guiding units 14 secured to the front face of the supporting frame with two disposed in alignment on each side thereof. Each guiding unit 14 has a first flange 141 and a second flange 142 which are located at a slight distance apart horizontally and vertically. A photograph 5 is located in place with the edges thereof held by the first flanges 141 thereof. Similarly a transparent glass 20 or the like is held in place by way of the second flanges of the guiding units, covering the surface of the photograph.

The illumination loop 3 is particularly made to have a plurality of wavy protrusions 331, 332 of two different sizes disposed consecutively one after the other on the inner side thereof for effecting better light transmission result.

Furthermore, the light components can be of LED bulb components or other energy-saving electrical light-generating means; and the arrangement of the light components is not limited but is intended to produce the best illumination effect. For instance, the LED components 32 can be located at the respective corner of the photo frame when the size of the same is quite large so that light can be better and more evenly cast on the photograph with the help of the light reflection pieces.

As shown in FIG. 7 when the photo frame is made to have a relatively large size with the LED bulb components not able to provide satisfactory illumination effect, the illumination is then replaced by a neon light tube defined in accordance with the shape of the photo frame, in such a case, a rectifier is used to enable the present invention to operate in AC.

Furthermore, the leg portion 311 of the supporting elements 31 is made to have such a length that the fixed supporting elements can support the illumination loop over the disposed photograph, thereby light can be best cast thereon, and the held illumination loop will be just located under the front cover secured to the flanges of the supporting frame 1.

I claim:

1. A light illuminated photo frame comprising: a front cover made of plastics, ceramics, acrylic resin, metal or wood and having a central opening for the exposition of a photograph received in said photo frame; a supporting frame having a front face with three sides thereof provided with a flange respectively consisting of a vertical wall and an outward extended horizontal fold on which a number of holes is disposed so that said front cover can be fastened thereto either by screws or by glue, a battery box integrally disposed on the rear side of said supporting frame and with a CDS light control means disposed thereon and in operative relation with LED light bulb means so as to permit switching said LED light bulb means on and off automatically by the intensity of external light, an adaptor jack disposed on said battery box, a supporting leg adapted for erecting said photo frame, a pair of slots in orthogonal relation with each other being disposed on the rear side of said supporting frame, the top end of said supporting leg being in selective engagement with one of said slots so as to permit the disposition of said photo frame to vary, and a number of guiding units secured to said front face of said supporting frame for fixing a photograph and a piece of transparent glass or the like in place; each said guiding unit being provided with a first flange and a second flange which are spaced vertically and horizontally at a slight distance with each other; at least two of said guiding units being disposed in alignment with each other at one side of said front face so as to permit the photograph and the glass to be simultaneously fixed in place by said first and second flanges reflecting surfaces on the flanged sides of said front face in place to receive light from said LED light bulb means and reflect same toward the place in the photo frame where a photo may be exposed, whereby said light bulb means produces illumination light which is delivered around the photo frame so that the photograph disposed in said photo frame can be seen in the dark.

2. A light illuminated photo frame as claimed in claim 1 wherein said vertical walls of said flanges of the supporting frame are provided with light reflection means of aluminum foils or mirrors, so as to better focus light onto the photograph disposed in said photo frame.

3. A light illumination photo frame as claimed in claim 1 wherein said supporting frame can be made in any geometric shape, and said front cover accordingly made.

* * * * *